US009719234B1

(12) United States Patent
Christopher et al.

(10) Patent No.: US 9,719,234 B1
(45) Date of Patent: Aug. 1, 2017

(54) SYSTEM AND METHOD FOR PREVENTING WATER PIPE FREEZE USING INTERNET OF THINGS (IOT)

(71) Applicant: AMERICAN MEGATRENDS, INC., Norcross, GA (US)

(72) Inventors: Samvinesh Christopher, Suwanee, GA (US); Joseprabu Inbaraj, Suwanee, GA (US); Chandrasekar Rathineswaran, Duluth, GA (US)

(73) Assignee: AMERICAN MEGATRENDS, INC., Norcross, GA (US)

( * ) Notice: Subject to any disclaimer, the term of this patent is extended or adjusted under 35 U.S.C. 154(b) by 0 days.

(21) Appl. No.: 15/070,582

(22) Filed: Mar. 15, 2016

(51) Int. Cl.
*E03B 7/10* (2006.01)
*E03B 7/12* (2006.01)

(52) U.S. Cl.
CPC ..... *E03B 7/12* (2013.01); *Y10T 137/1353* (2015.04)

(58) Field of Classification Search
CPC ..... E03B 37/12; E03B 7/10; Y10T 137/1353
See application file for complete search history.

(56) References Cited

U.S. PATENT DOCUMENTS 3,369,556 A * 2/1968 Allderdice ..... F16K 49/00 137/236.1
4,672,990 A * 6/1987 Robillard ..... E03B 7/12 126/588
6,021,798 A * 2/2000 Martin ..... E03B 7/10 137/59
7,104,461 B2 * 9/2006 Restivo, Sr. ..... E03B 7/12 236/12.1
8,498,523 B2 * 7/2013 Deivasigamani ... F24D 17/0026 392/307
8,543,244 B2 * 9/2013 Keeling ..... F24D 19/1066 700/276
8,944,086 B2 * 2/2015 Park ..... E03B 7/08 137/62
9,151,023 B2 * 10/2015 Taylor ..... E03B 7/08
2010/0133258 A1 * 6/2010 Fima ..... F17D 5/02 219/482
2013/0025709 A1 * 1/2013 Mann ..... E03B 7/10 137/468
2014/0261693 A1 * 9/2014 Geerligs ..... E03B 7/12 137/1

(Continued)

*Primary Examiner* — Craig Schneider
*Assistant Examiner* — Kevin Barss
(74) *Attorney, Agent, or Firm* — Locke Lord LLP; Tim Tingkang Xia, Esq.

(57) ABSTRACT

Certain aspects direct to systems and methods for preventing water pipe freeze. A water supply system includes a water pipe and an Internet of Things (IoT) tap device switchable between an open state and a closed state. An IoT temperature sensor is disposed on the water pipe to detect an environmental temperature of the water pipe and generate a corresponding temperature signal. The IoT tap device is communicatively connected to the at least one IoT temperature sensor. In operation, the IoT tap device requests and receives the temperature signal from the temperature sensor, and determines the environmental temperature based on the temperature signal. When the environmental temperature is at or below a threshold temperature, such as a freezing point of water, the IoT tap device controls its tap to switch to the open state such that water flows or drips out from the tap.

15 Claims, 4 Drawing Sheets

(56) References Cited

U.S. PATENT DOCUMENTS

2014/0314062 A1* 10/2014 Loebs ..... H04L 12/2803
370/338
2015/0075638 A1* 3/2015 Park ..... E03B 7/08
137/59

* cited by examiner

SYSTEM AND METHOD FOR PREVENTING WATER PIPE FREEZE USING INTERNET OF THINGS (IOT)

FIELD

The present disclosure relates generally to Internet of Things (IoT) technology, and more particularly to systems and methods for preventing water pipe freeze using IoT.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

It is well known that, when temperature drops below the freeze point, the water in supply water pipes may freeze to become ice, which may expand and break the pipe. Millions of gallons of water have been wasted due to water pipe break every year.

Normally, the water pipe freeze may be prevented by turning on a water tap for dripping, which allows the water in the water pipe to keep moving or flowing, so as to prevent from freezing. However, people often forget to turn on the water tap for dripping when a freeze warning is issued.

Therefore, an unaddressed need exists in the art to address the aforementioned deficiencies and inadequacies.

SUMMARY

Certain aspects of the disclosure direct to a system for preventing water pipe freeze. In certain embodiments, the system includes a water supply system, at least one Internet of Things (IoT) temperature sensor, and an IoT device communicatively connected to the at least one IoT temperature sensor. The water supply system includes a water pipe for supplying water, and a tap connected to the water pipe. The tap is switchable between an open state and a closed state, where water supplied by the water pipe flows out from the tap in the open state and does not flow out from the tap in the closed state. The at least one IoT temperature sensor is disposed on the water pipe, configured to detect an environmental temperature of the water pipe and generate a temperature signal based on the environmental temperature. The IoT device includes a processor and a storage device storing computer executable code. The computer executable code, when executed at the processor, is configured to: request and receive the temperature signal from the at least one IoT temperature sensor; determine the environmental temperature based on the temperature signal; and when the environmental temperature is at or below a threshold temperature, control the tap to switch to the open state such that water flows out from the tap.

In certain embodiments, the computer executable code, when executed at the processor, is further configured to: when the environmental temperature is above the threshold temperature, control the tap to switch to the closed state.

In certain embodiments, the threshold temperature is a temperature of a freezing point of water.

In certain embodiments, the IoT device is communicatively connected to the at least one IoT temperature sensor via peer-to-peer (P2P) communication. In certain embodiments, the P2P communication may be adHoc Wi-Fi communication, Wi-Fi direct communication, or Bluetooth communication.

In certain embodiments, the computer executable code is configured to, when the environmental temperature is at or below a threshold temperature, control the tap to switch to the open state at a flow rate, wherein the flow rate is determined based on the environmental temperature. In certain embodiments, the flow rate is adjustable between a dripping rate and a constant flow rate. In certain embodiments, the computer executable code, when executed at the processor, is further configured to: when the environmental temperature is at or below the threshold temperature and above a super-cold temperature, control the tap to switch to the open state at the dripping rate; and when the environmental temperature is at or below the super-cold temperature, control the tap to switch to the open state at the constant flow rate.

Certain aspects of the disclosure direct to a method for preventing water pipe freeze, including: detecting, by at least one IoT temperature sensor disposed on a water pipe of a water supply system, an environmental temperature of the water pipe and generating a temperature signal based on the environmental temperature; requesting and receiving, by an IoT device disposed on a tap of the water supply system, the temperature signal from the at least one IoT temperature sensor, wherein the tap is connected to the water pipe and is switchable between an open state and a closed state, wherein water supplied by the water pipe flows out from the tap in the open state and does not flow out from the tap in the closed state; determining, by the IoT device, the environmental temperature based on the temperature signal; and when the environmental temperature is at or below a threshold temperature, controlling, by the IoT device, the tap to switch to the open state such that water flows out from the tap, wherein the threshold temperature is a temperature of a freezing point of water.

In certain embodiments, the method further includes: when the environmental temperature is above the threshold temperature, controlling, by the IoT device, the tap to switch to the closed state.

In certain embodiments, the IoT device is communicatively connected to the at least one IoT temperature sensor via P2P communication. In certain embodiments, the P2P communication may be adHoc Wi-Fi communication, Wi-Fi direct communication, or Bluetooth communication.

In certain embodiments, when the environmental temperature is at or below a threshold temperature, the IoT device is configured to control the tap to switch to the open state at a flow rate, wherein the flow rate is determined based on the environmental temperature. In certain embodiments, the flow rate is adjustable between a dripping rate and a constant flow rate. In certain embodiments, the IoT device is configured to: when the environmental temperature is at or below the threshold temperature and above a super-cold temperature, control the tap to switch to the open state at the dripping rate; and when the environmental temperature is at or below the super-cold temperature, control the tap to switch to the open state at the constant flow rate.

Certain aspects of the present disclosure relates to a non-transitory computer readable medium storing computer executable code. The computer executable code, when executed at a processor of an IoT device, is configured to: request and receive a temperature signal from at least one IoT temperature sensor, wherein the at least one IoT temperature sensor is disposed on a water pipe of a water supply system, configured to detect an environmental temperature of the water pipe and generate the temperature signal based on the environmental temperature, and the IoT device is disposed on a tap of the water supply system, wherein the tap is connected to the water pipe and is switchable between an open state and a closed state, wherein water supplied by the water pipe flows out from the tap in the open state and does not flow out from the tap in the closed state; determine the environmental temperature based on the temperature signal; and when the environmental temperature is at or below a threshold temperature, control the tap to switch to the open state such that water flows out from the tap, wherein the threshold temperature is a temperature of a freezing point of water.

In certain embodiments, the computer executable code, when executed at the processor, is further configured to: when the environmental temperature is above the threshold temperature, control the tap to switch to the closed state.

In certain embodiments, the IoT device is communicatively connected to the at least one IoT temperature sensor via P2P communication. In certain embodiments, the P2P communication may be adHoc Wi-Fi communication, Wi-Fi direct communication, or Bluetooth communication.

In certain embodiments, the computer executable code is configured to, when the environmental temperature is at or below a threshold temperature, control the tap to switch to the open state at a flow rate, wherein the flow rate is determined based on the environmental temperature. In certain embodiments, the flow rate is adjustable between a dripping rate and a constant flow rate. In certain embodiments, the computer executable code, when executed at the processor, is further configured to: when the environmental temperature is at or below the threshold temperature and above a super-cold temperature, control the tap to switch to the open state at the dripping rate; and when the environmental temperature is at or below the super-cold temperature, control the tap to switch to the open state at the constant flow rate.

These and other aspects of the present disclosure will become apparent from the following description of the preferred embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, wherein.

DETAILED DESCRIPTION

Figure 1:
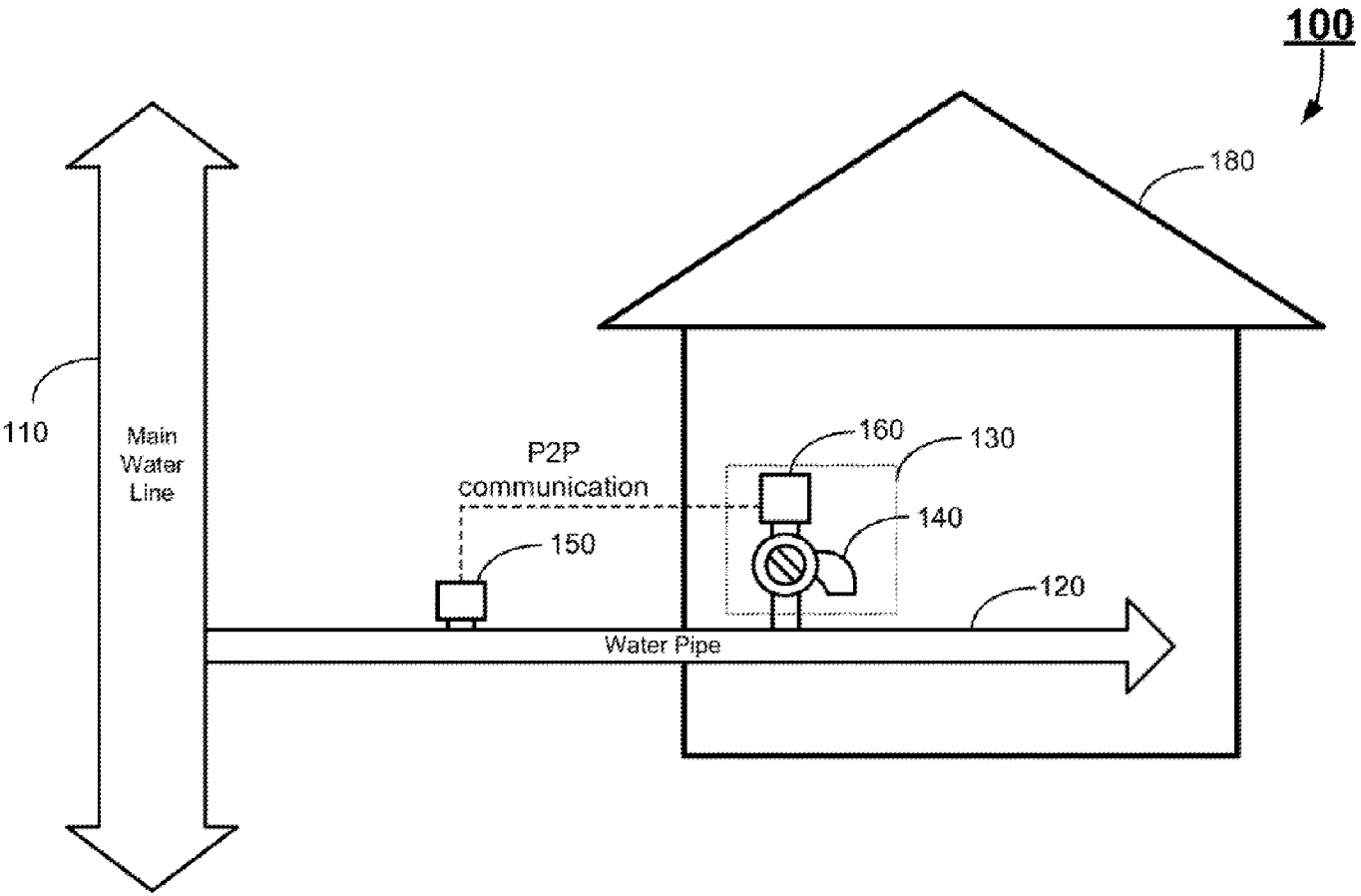
FIG. 1 schematically depicts a system according to certain embodiments of the present disclosure.

The present disclosure is more particularly described in the following examples that are intended as illustrative only since numerous modifications and variations therein will be apparent to those skilled in the art. Various embodiments of the disclosure are now described in detail. Referring to the drawings, like numbers, if any, indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present disclosure. Additionally, some terms used in this specification are more specifically defined below.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, "plurality" means two or more.

As used herein, the terms "comprising," "including," "carrying," "having," "containing," "involving," and the like are to be understood to be open-ended, i.e., to mean including but not limited to.

As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term "module" may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term "code", as used herein, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The term "interface", as used herein, generally refers to a communication tool or means at a point of interaction between components for performing data communication between the components. Generally, an interface may be applicable at the level of both hardware and software, and may be uni-directional or bi-directional interface. Examples of physical hardware interface may include electrical connectors, buses, ports, cables, terminals, and other I/O devices or components. The components in communication with the interface may be, for example, multiple components or peripheral devices of a computer system.

The terms "chip" or "computer chip", as used herein, generally refer to a hardware electronic component, and may refer to or include a small electronic circuit unit, also known as an integrated circuit (IC), or a combination of electronic circuits or ICs.

Certain embodiments of the present disclosure relate to computer systems. As depicted in the drawings, computer components may include physical hardware components, which are shown as solid line blocks, and virtual software components, which are shown as dashed line blocks. One of ordinary skill in the art would appreciate that, unless otherwise indicated, these computer components may be implemented in, but not limited to, the forms of software, firmware or hardware components, or a combination thereof.

The apparatuses, systems and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Certain aspects of the present disclosure are directed to systems and methods for preventing water pipe freeze using Internet of Things (IoT) technology. IoT is the network of physical objects, including devices, vehicles, buildings and other items embedded with electronics, software, sensors, and network connectivity, that enables these objects to collect and exchange data. Recently, IoT devices have become very popular with its characteristics of automation and being easy to use. Thus, IoT technology may be used for a water supply system to prevent water pipe freeze without user intervention, thus saving millions of gallons of water that may be wasted due to water pipe breaks.

In certain embodiments, the system for preventing water pipe freeze may include two IoT devices: one is a temperature sensor which is kept in a water pipe to monitor the environmental temperature of the water pipe, and the other is an IoT device to control the tap based on the environmental temperature. The two IoT device communicate with each other. When the environmental temperature drops below the freezing temperature, the IoT device may control the tap to turn on for dripping or flowing, such that the water in the water pipe flows to prevent from freezing. Once the environmental temperature increases and crosses the freezing point, the IoT device may control the tap to turn off.

One aspect of the present disclosure relates to a system for preventing water pipe freeze. FIG. 1 schematically depicts a system according to certain embodiments of the present disclosure. As shown in FIG. 1, the system 100 includes a water supply system for supplying water for a house 180. However, the water supply system may supply water to any designated indoor or outdoor locations, without being limited thereto. Specifically, the water supply system includes a main water line 110, a water pipe 120 connected to the main water line 110, and an IoT tap device 130 connected to the water pipe 120. The IoT tap device 130 includes a tap 140 and an IoT device 150 controlling the tap 140. Further, an IoT temperature sensor 150 is disposed on the water pipe 120.

The main water line 110 is a large water pipe being connected to a water supply source, such as a municipal water supply system, to provide tap water for the house 180. The water pipe 120 is a branch pipe being connected to the main water line 110 for supplying water from the main water line 110 to the tap 140. In certain embodiments, the main water line 110 and the water pipe 120 may each be a single pipe, or may each be a pipe system which include a plurality of branch pipes. It should be noted that the shapes of the main water line 110 and the water pipe 120 may vary, and are not limited to straight pipelines. Generally, the main water line 110 and the water pipe 120 may be buried under the ground to avoid being exposed to sunlight, rain, snow and other potential environmental hazardous conditions. As shown in FIG. 1, a part of the water pipe 120 is located outside the house 180. Thus, when the environmental temperature drops to the freezing point of water (0° C. or 32° F. under the standard atmosphere of 1 atm), the water in the water pipe 120 may be under the risk of freezing if the water is not flowing.

The tap 140, also referred to as a faucet, is a device connected to the water pipe 120 to control the release of water from the water pipe 120. Examples of the tap 140 may include a valve or other devices which may be switchable between an open state and a closed state. When the tap 140 is switched to the open state, water supplied by the water pipe may flow out from the tap 140. On the other hand, when the tap 140 is switched to the closed state, water supplied by the water pipe may not flow out from the tap 140 such that the water remains within the water pipe 120.

The IoT temperature sensor 150 is an IoT device for monitoring the environmental temperature of the water pipe 120. In certain embodiments, the IoT temperature sensor 150 may include a sensing element, which is configured to detect the environmental temperature at the location where the sensing element is located, and generate a corresponding temperature signal based on the environmental temperature being detected. Further, the IoT temperature sensor 150 may include a communication module to send the temperature signal to the IoT device 160. In certain embodiments, the IoT temperature sensor 150 may be disposed on the water pipe 120, and the location of the IoT temperature sensor 150 may be selected based on environmental factors. For example, the IoT temperature sensor 150 may be disposed inside an outdoor section of the water pipe 120, which is buried under the ground, since the outdoor section of the water pipe 120 is under the greater risk of water pipe freeze.

The IoT device 160 is a device with IoT functionalities, which communicates with the IoT temperature sensor 150 and controls the release of water of the tap 140. In certain embodiments, the IoT device 160 is communicatively connected to the IoT temperature sensor 150 via peer-to-peer (P2P) communication. Examples of the P2P communication may include adHoc Wi-Fi communication, Wi-Fi direct communication, Bluetooth communication, or any other types of P2P communication. In certain embodiments, the IoT device 160 is configured to request and receive the temperature signal from the IoT temperature sensor 150, and determine the environmental temperature based on the temperature signal received. When the IoT device 160 determines that the environmental temperature is at or below a threshold temperature, such as the freezing point of water, the IoT device 160 may control the tap 140 to switch to the open state, such that water flows or drips out from the tap 140. In this case, the water in the water pipe 120 is flowing out through the tap 140 to avoid freezing. On the other hand, when the IoT device 160 determines that the environmental temperature is above the threshold temperature (e.g., the freezing point), the IoT device 160 may control the tap 140 to switch to the closed state, such that water stops flowing out from the tap 140.

Generally, the water in the water pipe 120 may be under the risk of freezing when the environmental temperature drops below the freezing point. In certain embodiments, when the water supply system is located in an extremely cold area where the environmental temperature may drop even further to a temperature way below the freezing point, such that merely turning on the tap 140 for dripping may not be sufficient to prevent from water pipe freeze. In this case, the IoT device 160 may be configured to control the tap 140 to switch to the open state at a flow rate, where the flow rate of the tap 140 is adjustable between multiple rates. For example, a super-cold temperature below the freezing point, e.g., −40° C. (−40° F.), may be preset as a second threshold temperature, where the flow rate of the tap 140 may be set to a dripping rate when the environmental temperature is above the super-cold temperature, and to a constant flow rate greater than the dripping rate when the environmental temperature is at or below the super-cold temperature. When the environmental temperature is at or below the threshold temperature (the freezing point), the IoT device 160 further determines whether the environmental temperature is above the super-cold temperature or not. When the environmental temperature is above the super-cold temperature, the IoT device 160 may control the tap 140 to switch to the open state at the dripping rate. When the environmental temperature is at or below the super-cold temperature, the IoT device 160 may control the tap 140 to switch to the open state at the constant flow rate.

Figure 2:
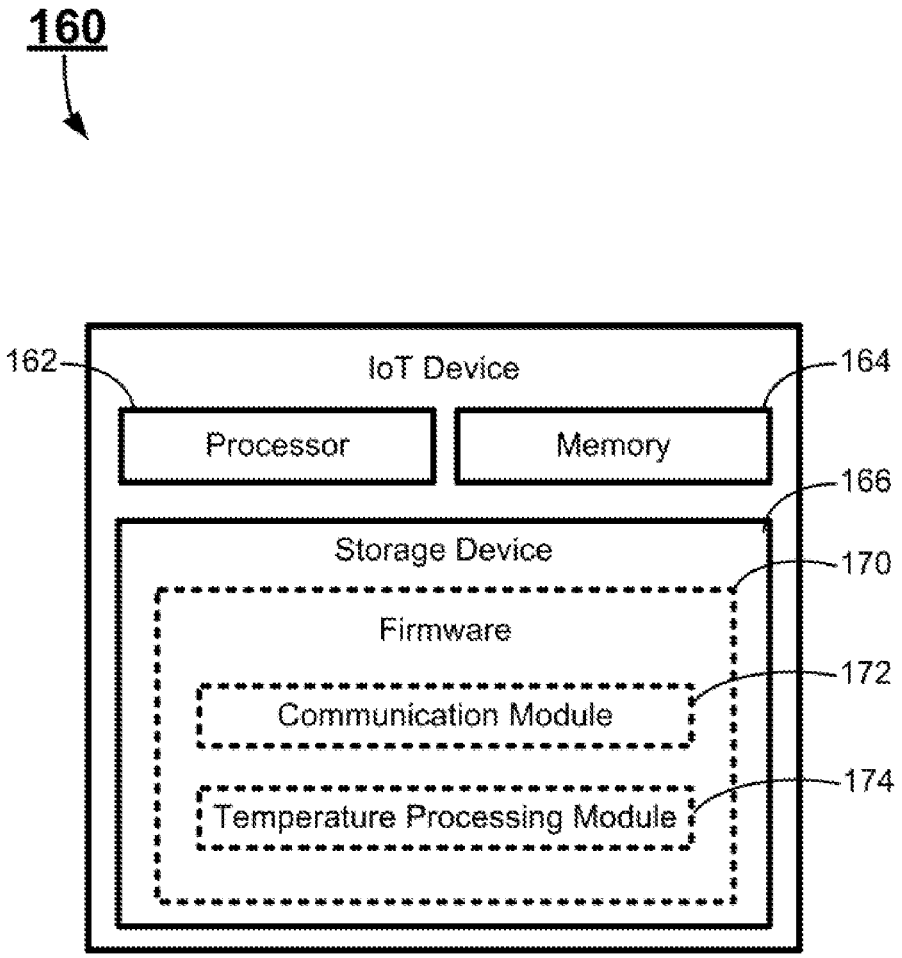
FIG. 2 schematically depicts an IoT device according to certain embodiments of the present disclosure.

FIG. 2 schematically depicts an IoT device according to certain embodiments of the present disclosure. In certain embodiments, the IoT device 160 is a part of the IoT tap device 130, and may be formed by a microcontroller or microprocessor chip or any other may include necessary hardware and software components to perform certain predetermined tasks, such as controlling of the tap 140 and P2P communication capabilities with the IoT temperature sensor 150. As shown in FIG. 2, the IoT device 160 has a processor 162, a memory 164 and a storage device 166. In certain embodiments, the IoT device 160 may include other hardware components and software components (not shown) to perform its corresponding tasks. Examples of these hardware and software components may include, but not limited to, other required memory, communication interfaces, buses, Input/Output (I/O) modules and peripheral devices.

The processor 162 is configured to control operation of the IoT device 160. In certain embodiments, the processor 162 may be a microprocessor with necessary processing capabilities. In certain embodiments, the processor 162 may be a central processing unit (CPU). The processor 162 can execute any computer executable code or instructions stored in the storage device 166. In certain embodiments, the IoT device 160 may run on more than one processor, such as two processors or any suitable number of processors.

The memory 164 can be a volatile memory, such as a random-access memory (RAM), for storing the data and information during the operation of the IoT device 160. For example, the memory 164 may be used to store the temperature signal received from the IoT temperature sensor 150.

The storage device 166 is a non-volatile data storage media for storing the computer executable code or instructions of the IoT device 160. Examples of the storage device 166 may include flash memory, memory cards, or any other types of data storage devices. In certain embodiments, the computer executable code stored in the storage device 166 is the firmware 170, which may include one or more firmware modules. As shown in FIG. 2, the firmware 170 includes a communication module 172 and a temperature processing module 174.

The communication module 172 includes the computer executable code or instructions for performing P2P communication with the IoT temperature sensor 150. For example, when the P2P communication is adHoc Wi-Fi communication or Wi-Fi direct communication, the communication module 172 may be a Wi-Fi communication module. On the other hand, when the P2P communication is Bluetooth communication, the communication module 172 may be a Bluetooth communication module. Specifically, the communication module 172 periodically requests and receives the temperature signal from the IoT temperature sensor 150, and sends the temperature signal to the temperature processing module 174 for further processing.

The temperature processing module 174 includes the computer executable code or instructions for processing the temperature signal, determining the environmental temperature, and determining whether the environmental temperature meets the condition to turn on or turn off the tap 140. In certain embodiments, when the temperature processing module 174 receives the temperature signal sent by the communication module 172, the temperature processing module 174 determines the environmental temperature based on the temperature signal, compares the environmental temperature to the threshold temperature (e.g., the freezing point) and/or the super-cold temperature if such super-cold temperature exists, and control the tap 140 to turn on or turn off based on the comparison results.

In certain embodiments, when the water supply system includes a complicated system multiple branch water pipes 120, the system 100 may include multiple IoT temperature sensors 150 located at different locations of the water pipe 120, and the IoT device 160 may perform P2P communication to each of the IoT temperature sensors 150 to obtain temperature signals from different locations. In certain embodiments, the water supply system may further include multiple taps 140, and each tap 140 may include its corresponding IoT device 160 to form a plurality of IoT tap devices 130, and each IoT device 160 may correspond to one of the multiple IoT temperature sensors 150 to perform P2P communication therebetween.

In certain embodiments, the threshold temperature may be set based on the environment of the water supply system. For example, when the water supply system is located in a high altitude area, such as a mountain area, the freezing point of water may change to be below 0° C. or 32° F. due to the change of the atmosphere at the higher altitude. In this case, the threshold temperature may be set accordingly.

Figure 3:
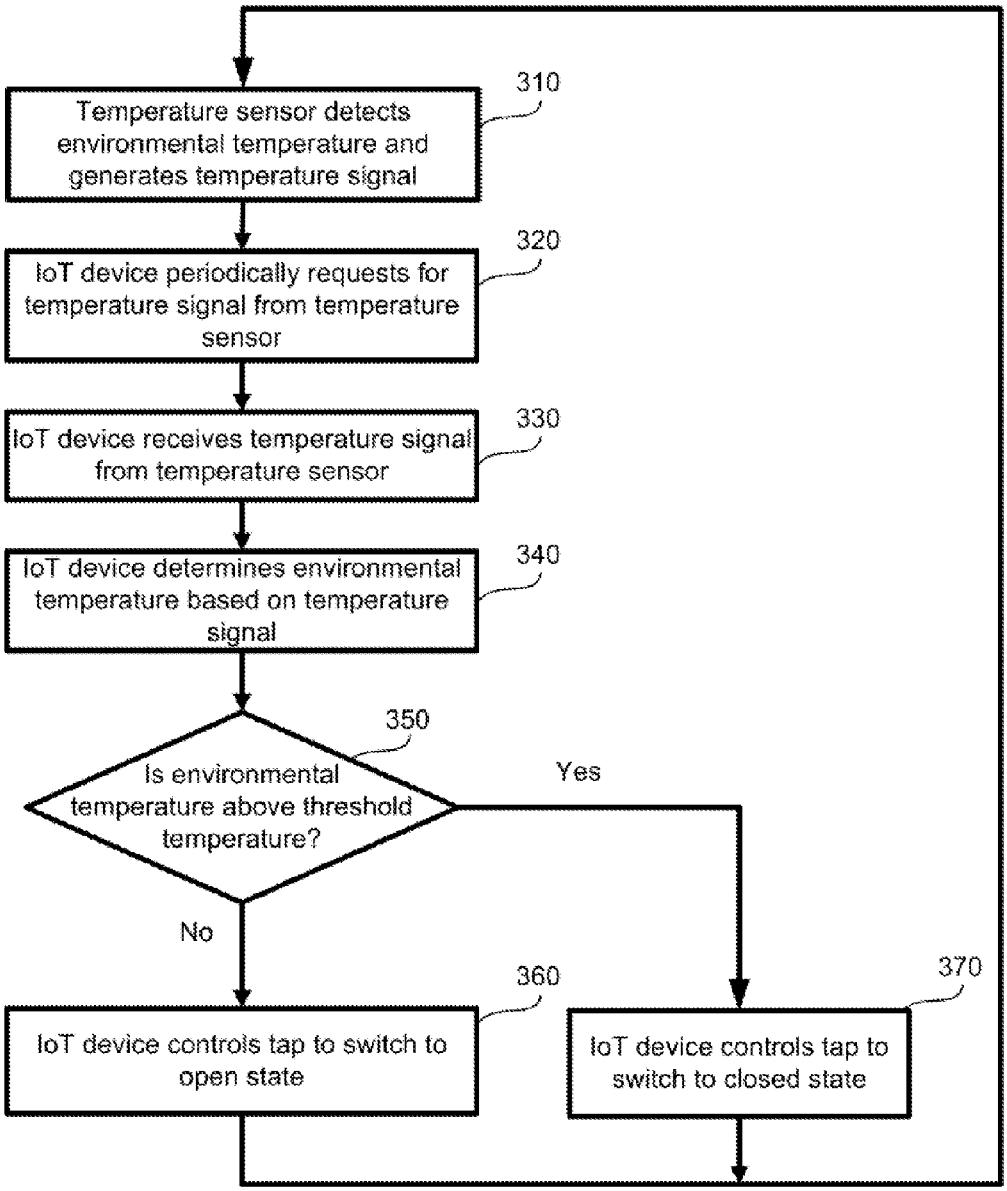
FIG. 3 depicts a flowchart of a method for preventing water pipe freeze according to certain embodiments of the present disclosure.

Another aspect of the present disclosure relates to a method for preventing water pipe freeze. FIG. 3 depicts a flowchart of a method for preventing water pipe freeze according to certain embodiments of the present disclosure. In certain embodiments, the method as shown in FIG. 3 may be implemented by the system 100 as shown in FIGS. 1 and 2.

As shown in FIG. 3, at procedure 310, the IoT temperature sensor 150 detects the environmental temperature, and generates a corresponding temperature signal based on the environmental temperature being detected. At procedure 320, the IoT device 160 periodically requests for the temperature signal from the IoT temperature sensor 150. For example, the IoT device 160 may request for the temperature signal from the IoT temperature sensor 150 every 30 seconds. At procedure 330, the IoT device 160 receives the temperature signal from the IoT temperature sensor 150. At procedure 340, the IoT device 160 determines the environmental temperature based on the temperature signal received. At procedure 350, the IoT device 160 compares the environmental temperature to the threshold temperature (e.g., the freezing point), and determines whether the environmental temperature is above the threshold temperature. When the environmental temperature is at or below (i.e., not above) the threshold temperature, the IoT device 160 moves to procedure 360 to control the tap 140 to switch to the open state, such that water starts dripping or flowing out. On the other hand, when the environmental temperature is above the threshold temperature, the IoT device 160 moves to procedure 370 to control the tap 140 to switch to the closed state. Thus, the tap 140 may be automatically controlled by the IoT device 160 based on the environmental temperature.

Figure 4:
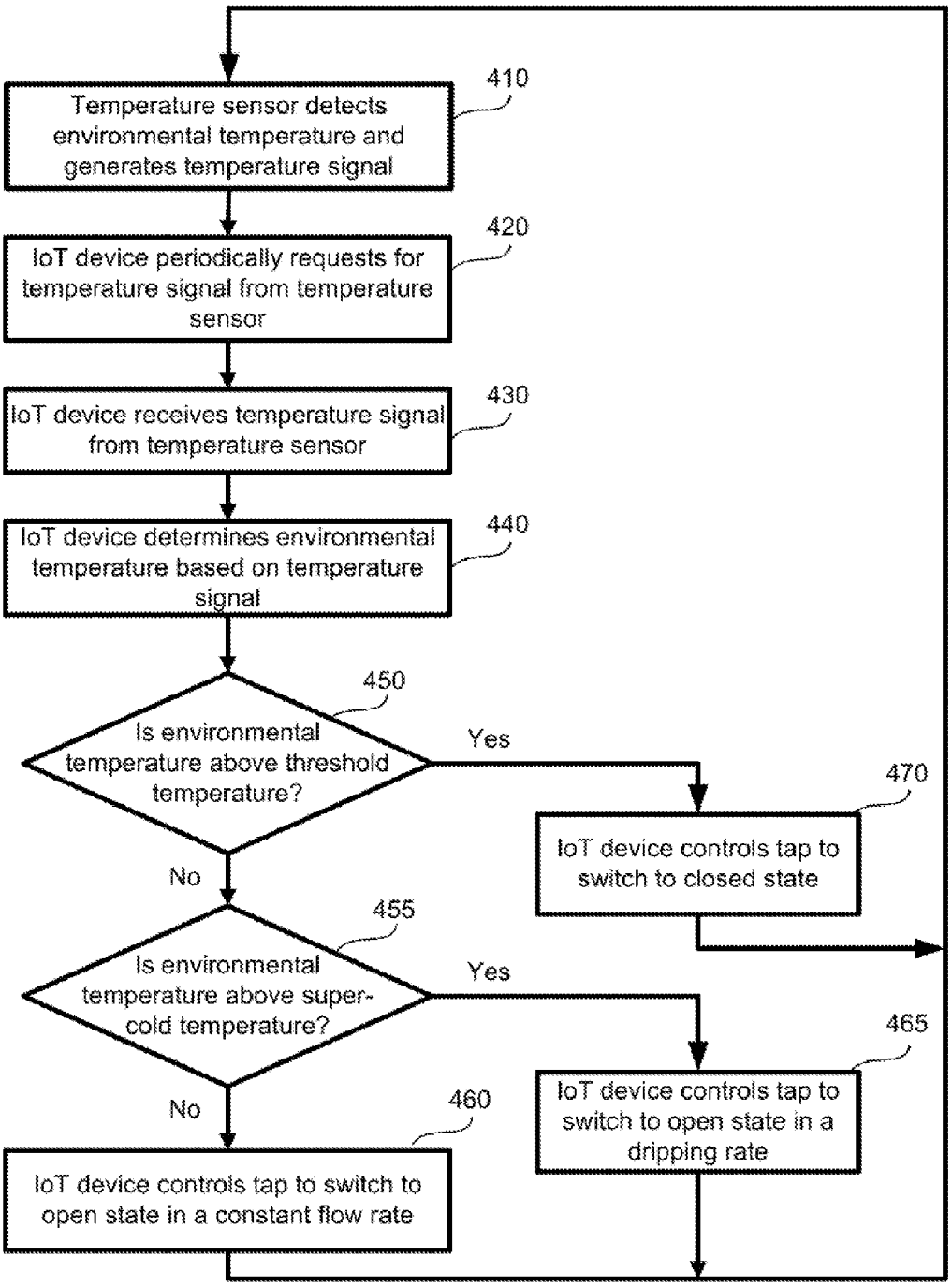
FIG. 4 depicts a flowchart of a method for preventing water pipe freeze according to certain embodiments of the present disclosure.

FIG. 4 depicts a flowchart of a method for preventing water pipe freeze according to certain embodiments of the present disclosure. In certain embodiments, the method as shown in FIG. 4 may be implemented by the system 100 as shown in FIGS. 1 and 2.

As shown in FIG. 4, at procedure 410, the IoT temperature sensor 150 detects the environmental temperature, and generates a corresponding temperature signal based on the environmental temperature being detected. At procedure 420, the IoT device 160 periodically requests for the temperature signal from the IoT temperature sensor 150. For example, the IoT device 160 may request for the temperature signal from the IoT temperature sensor 150 every 30 seconds. At procedure 430, the IoT device 160 receives the temperature signal from the IoT temperature sensor 150. At procedure 440, the IoT device 160 determines the environmental temperature based on the temperature signal received. At procedure 450, the IoT device 160 compares the environmental temperature to the threshold temperature (e.g., the freezing point), and determines whether the environmental temperature is above the threshold temperature. When the environmental temperature is above the threshold temperature, the IoT device 160 moves to procedure 470 to control the tap 140 to switch to the closed state. On the other hand, when the environmental temperature is at or below (i.e., not above) the threshold temperature, the IoT device 160 moves to procedure 455 to compare the environmental temperature to the super-cold temperature (e.g., a temperature way below the freezing point), and determine whether the environmental temperature is above the super-cold temperature. When the environmental temperature is at or below (i.e., not above) the super-cold temperature, the IoT device 160 moves to procedure 460 to control the tap 140 to switch to the open state in a constant flow rate, such that water starts flowing out in the higher flow rate to prevent from freezing in the super-cold environment. On the other hand, when the environmental temperature is above the super-cold temperature, the IoT device 160 moves to procedure 465 to control the tap 140 to switch to the open state in a dripping rate, such that water starts dripping in the lower dripping rate to prevent from freezing. Thus, the tap 140 may be automatically controlled by the IoT device 160, and the flow rate may be adjusted between the dripping rate and the constant flow rate based on the environmental temperature.

In a further aspect, the present disclosure is related to a non-transitory computer readable medium storing computer executable code. The code, when executed at one or more processor of an IoT device 160, may perform the method as described above to control the tap 140. In certain embodiments, the non-transitory computer readable medium may include, but not limited to, any storage media of the IoT device 160. In certain embodiments, the non-transitory computer readable medium may be implemented as the non-volatile storage device 166 of the IoT device 160 as shown in FIG. 2.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. A system for preventing water pipe freeze, comprising:

a water supply system, comprising:

a water pipe for supplying water; and a tap connected to the water pipe, the tap being switchable between an open state and a closed state, wherein water supplied by the water pipe flows out from the tap in the open state and does not flow out from the tap in the closed state;

at least one Internet of Things (IoT) temperature sensor disposed on the water pipe, configured to detect an environmental temperature of the water pipe and generate a temperature signal based on the environmental temperature; and an IoT device disposed on the tap and communicatively connected to the at least one IoT temperature sensor, the IoT device comprising a processor and a storage device storing computer executable code, wherein the computer executable code, when executed at the processor, is configured to:

request and receive the temperature signal from the at least one IoT temperature sensor;

determine the environmental temperature based on the temperature signal;

when the environmental temperature is at or below a threshold temperature and above a super-cold temperature, control the tap to switch to the open state at a dripping rate such that water flows out from the tap at the dripping rate; and when the environmental temperature is at or below the super-cold temperature, control the tap to switch to the open state at a constant flow rate such that water flows out from the tap at the constant flow rate, wherein the constant flow rate is greater than the dripping rate.

2. The system as claimed in claim 1, wherein the computer executable code, when executed at the processor, is further configured to:

when the environmental temperature is above the threshold temperature, control the tap to switch to the closed state.

3. The system as claimed in claim 1, wherein the threshold temperature is a temperature of a freezing point of water.

4. The system as claimed in claim 1, wherein the IoT device is communicatively connected to the at least one IoT temperature sensor via peer-to-peer (P2P) communication.

5. The system as claimed in claim 4, wherein the P2P communication is adHoc Wi-Fi communication, Wi-Fi direct communication, or Bluetooth communication.

6. A method for preventing water pipe freeze, comprising:

detecting, by at least one Internet of Things (IoT) temperature sensor disposed on a water pipe of a water supply system, an environmental temperature of the water pipe and generating a temperature signal based on the environmental temperature;

requesting and receiving, by an IoT device disposed on a tap of the water supply system, the temperature signal from the at least one IoT temperature sensor, wherein the tap is connected to the water pipe and is switchable between an open state and a closed state, wherein water supplied by the water pipe flows out from the tap in the open state and does not flow out from the tap in the closed state;

determining, by the IoT device, the environmental temperature based on the temperature signal;

when the environmental temperature is at or below a threshold temperature and above a super-cold temperature, controlling, by the IoT device, the tap to switch to the open state at a dripping rate such that water flows out from the tap at the dripping rate; and when the environmental temperature is at or below the super-cold temperature, controlling, by the IoT device, the tap to switch to the open state at a constant flow rate such that water flows out from the tap at the constant flow rate, wherein the constant flow rate is greater than the dripping rate.

7. The method as claimed in claim 6, further comprising:

when the environmental temperature is above the threshold temperature, controlling, by the IoT device, the tap to switch to the closed state.

8. The method as claimed in claim 6, wherein the IoT device is communicatively connected to the at least one IoT temperature sensor via peer-to-peer (P2P) communication.

9. The method as claimed in claim 8, wherein the P2P communication is adHoc Wi-Fi communication, Wi-Fi direct communication, or Bluetooth communication.

10. The method as claimed in claim 6, wherein the threshold temperature is a temperature of a freezing point of water.

11. A non-transitory computer readable medium storing computer executable code, wherein the computer executable code, when executed at a processor of an Internet of Things (IoT) device, is configured to:

request and receive a temperature signal from at least one IoT temperature sensor, wherein the at least one IoT temperature sensor is disposed on a water pipe of a water supply system, configured to detect an environmental temperature of the water pipe and generate the temperature signal based on the environmental temperature, and the IoT device is disposed on a tap of the water supply system, wherein the tap is connected to the water pipe and is switchable between an open state and a closed state, wherein water supplied by the water pipe flows out from the tap in the open state and does not flow out from the tap in the closed state;

determine the environmental temperature based on the temperature signal;

when the environmental temperature is at or below a threshold temperature and above a super-cold temperature, control the tap to switch to the open state at a dripping rate such that water flows out from the tap at the dripping rate; and when the environmental temperature is at or below the super-cold temperature, control the tap to switch to the open state at a constant flow rate such that water flows out from the tap at the constant flow rate, wherein the constant flow rate is greater than the dripping rate.

12. The non-transitory computer readable medium as claimed in claim 11, the computer executable code, when executed at the processor, is further configured to:

when the environmental temperature is above the threshold temperature, control the tap to switch to the closed state.

13. The non-transitory computer readable medium as claimed in claim 11, wherein the IoT device is communicatively connected to the at least one IoT temperature sensor via peer-to-peer (P2P) communication.

14. The non-transitory computer readable medium as claimed in claim 13, wherein the P2P communication is adHoc Wi-Fi communication, Wi-Fi direct communication, or Bluetooth communication.

15. The non-transitory computer readable medium as claimed in claim 11, wherein the threshold temperature is a temperature of a freezing point of water.

* * * * *